US006141295A

United States Patent [19]

Lange et al.

[11] Patent Number: 6,141,295

[45] Date of Patent: Oct. 31, 2000

[54] DISPLAY SETTING ARRANGEMENT FOR A TIMEPIECE

[75] Inventors: Jürgen Lange; Kurt Klaus, both of Schaffhausen, Switzerland

[73] Assignee: IWC International Watch Co. AG, Schaffhausen, Switzerland

[21] Appl. No.: 09/277,404

[22] Filed: Mar. 26, 1999

[30] Foreign Application Priority Data

Apr. 5, 1998 [DE] Germany ..... 198 15 072

[51] Int. Cl.[7] ..... G04B 19/22; G04B 18/00

[52] U.S. Cl. ..... 368/27; 368/185

[58] Field of Search ..... 368/21, 27, 76, 368/80, 185, 190, 191, 192

[56] References Cited

U.S. PATENT DOCUMENTS 3,675,411 7/1972 Sakuma ..... 368/27

5,745,440 4/1998 Chen ..... 368/27

*Primary Examiner*—Vit Miska

*Attorney, Agent, or Firm*—Martin A. Farber

[57] ABSTRACT

A display setting arrangement for a timepiece, having a 12-hour display, on which, driven in a rotatable manner by a basic mechanism with two revolutions every 24 hours, the hours can be displayed. There is also a second hour display, which can be driven in a rotatable manner likewise by the basic mechanism. By means of a correction device, the 12-hour display can be adjusted manually relative to the second hour display. The second hour display is a 24-hour display and can be driven in a rotatable manner, in a direct gear train, by the basic mechanism of the time piece with one revolution every twenty-four hours. Via a force-fit connection, a 12-hour gear train can be driven in a rotatable manner, for the purpose of driving the 12-hour display, by a direct-gear-train wheel which is driven with one revolution every twelve hours. In this case, a setting device which can be actuated manually, it is possible to adjust, separately from one another, either the direct gear train or, by overcoming the force fit of the force-fit connection, the 12-hour gear train relative to the direct gear train.

24 Claims, 9 Drawing Sheets

DISPLAY SETTING ARRANGEMENT FOR A TIMEPIECE

FIELD AND BACKGROUND OF THE INVENTION

The invention relates to a display setting arrangement for a timepiece, in particular a wristwatch, having a 12-hour display, on which, driven in a rotatable manner by a basic mechanism with two revolutions every 24 hours, the hours can be displayed, having a second hour display, which can be driven in a rotatable manner likewise by the basic mechanism, and having a correction device, by means of which the 12-hour display can be adjusted manually relative to the second hour display.

In the case of such display setting arrangements, it is known to use the two hour displays for the purpose of displaying the time in different time zones. In this case, both hour displays are 12-hour displays.

SUMMARY OF THE INVENTION

The object of the invention is to provide a display setting arrangement of the type mentioned in the introduction which makes it possible either to adjust the 12-hour display separately or to adjust the 12-hour display and the second hour display jointly.

This object is achieved according to the invention in that the second hour display is a 24-hour display and can be driven in a rotatable manner, in a direct gear train, by the basic mechanism of the timepiece with one revolution every 24 hours, and in that, via a force-fit connection, a 12-hour gear train can be driven in a rotatable manner, for the purpose of driving the 12-hour display, by a direct-gear-train wheel which is driven with one revolution every 12 hours, it being the case that, by means of a setting device which can be actuated manually, it is possible to adjust, separately from one another, either the direct gear train or, by overcoming the force fit of the force-fit connection, the 12-hour gear train relative to the direct gear train. This embodiment, then, makes it possible to use the 24-hour display as a permanent display which is not normally to be adjusted, while the 12-hour display can be adapted to the change in time zones without the 24-hour display being affected. For a correction or basic setting of the 24-hour display, however, the basic mechanism is stopped and the 24-hour display and the 12-hour display are adjusted synchronously.

Such a display setting arrangement is particularly advantageous in the case of pilot's watches since, in aviation, the so-called UTC Universal Time Coordinated, which is measured in 24 hours, is used as standard time throughout the world. The 24-hour display may thus remain fixed, while the 12-hour display serves for the rapid setting of the respectively applicable local time, or the changeover of winter time and summer time, without the minute display and, if appropriate, a seconds display having to be actuated. If, however, it is necessary to reset the time, for example, following a stoppage of the timepiece, then this takes place jointly for both hour displays by virtue of the 24-hour display being adjusted.

For rapid adjustability of the 12-hour display, the setting device, which can be actuated manually, may have a correction drive mechanism which can be driven in a manually rotatable manner and by means of which it is possible to adjust an hour display wheel of the 12-hour gear train, said wheel being driven in rotation with two revolutions every 24 hours.

A advantageous embodiment of the force-fit connection consists in that the hour display wheel concentrically encloses a direct-gear-train star, which is driven with one revolution every 12 hours, and is connected thereto with a force fit.

In order to achieve adjustment of the 12-hour display with specific time segments, there may be arranged on the hour di splay wheel an hour ratchet which can be pivoted about a pivot spindle, parallel to the axis of rotation of the hour display wheel and star, and, at a distance from the pivot spindle, has an obtuse-angled engaging tooth which engages, with spring prestressing, in a tooth gap of the star.

It is advantageous in this case if the star is an hour star with twelve teeth since this then always results in exact adjustment by one hour precisely.

If a minute wheel of the basic mechanism can drive in a rotatable manner a change wheel which is concentrically connected in a rotationally fixed manner to a pinion, by means of which a star-driving hour wheel of the direct drive train can be driven in a rotatable manner with one revolution every 12 hours, then, during basic setting of the 24-hour display, it is not just the hours but also the minutes which are set. For this purpose, it is possible, in a straightforward manner, for the change wheel to be driven in a rotatable manner by a hand setting wheel which can be driven in a manually rotatable manner and belongs to the setting device, which can be actuated manually.

In order to be able to adjust both the 24-hour display and the 12-hour display using a joint setting arrangement, the hand setting wheel can be adjusted between a position in which it engages in the change wheel and a position in which it engages in the correction drive mechanism.

If the hand setting wheel can be set in a neutral position, between the position in which it engages in the change wheel and the position in which it engages in the correction drive mechanism, then undesirable adjustment of one of the hour displays is avoided.

For straightforward actuation, the hand setting wheel can be driven in a rotatable manner by a winder.

If, in this case, the winder can be set axially in two setting positions, it being the case that in the first setting position the hand setting wheel engages in the correction drive mechanism and in the second setting position it engages in the change wheel, then the winder serves as a joint setting element for the two hour displays, it preferably being the case that the winder can also be set in a third axial setting position, in which the hand setting wheel is disengaged both from the correction drive mechanism and from the change wheel, in order to avoid undesirable adjustment.

The winder can fulfill a third setting function in that the third axial setting position of the winder is a winding position for the purpose of winding the spring mechanism of the timepiece. As a result, just a single setting element is required for three different functions.

In principle, the direct gear train can drive a 24-hour indicator such that it passes over a 24-hour scale.

If the direct drive train has a 24-hour display wheel which is driven by the hour wheel, via one or more intermediate wheels, with one revolution every 24 hours and bears a 24-hour disk of the 24-hour display, then the 24-hour display, which is designed as an hour disk, may be arranged largely at any desired location of the face of the timepiece.

Particularly small overall dimensions of the timepiece can be achieved by the 24-hour disk being arranged coaxially with respect to the 12-hour display.

For this purpose, the 24-hour disk and the 24-hour display wheel preferably have a concentric opening through which there projects an hour stem of the 12-hour display, said stem bearing an hour hand.

If a date display can be driven by the hour display wheel, via a third gear train, then said date display changes with every second passage of the 12-hour hand over twelve hours. This means that the date is always displayed correctly in relation to the 12-hour display. If the 12-hour display is adjusted forward beyond midnight or back before midnight, then the date is also adjusted forward or back in accordance with the position of the 12-hour display. If the date has to be corrected following thirty-day months, then the 12-hour hand is rotated forward by two full revolutions using the winder. Correspondingly, on March 1st, said 12-hour hand has to be rotated forward by six revolutions.

In one straightforward embodiment, the date display may have a date ring which is arranged on a toothed ring and bears the characters of the date display, it being the case that the toothed ring can be advanced by one advancement step by means of the third gear train, and following thirty-one advancement steps has been rotated through 360°.

If the third gear train has a Maltese-cross drive mechanism which produces the advancement steps, then just low forces are necessary for the purpose of carrying out the advancement step. This also means that there is no risk, as a result of excessive adjustment resistance of the advancement of the date, of the force-fit connection of the 12-hour gear train to the direct gear train being overcome and undesirable time adjustment taking place.

In one straightforward embodiment, which requires just low advancement forces, the toothed ring can be driven such that it can be advanced by a date wheel which is coaxially connected in a rotationally fixed manner to a Maltese cross, it being the case that the Maltese cross can be advanced by a switching finger of a date switching wheel which can be driven in a rotatable manner.

The date switching wheel can preferably be driven in a rotatable manner, with one revolution every 24 hours, by the drive mechanism of a date reduction wheel which is in engagement with the hour display wheel, it being the case that the Maltese cross can be advanced by a fifth of a revolution per advancement step.

In order to achieve small overall dimensions of the timepiece, the toothed ring is preferably an internal toothed ring, which in this case may be coaxial with respect to the 12-hour display and/or the 24-hour display.

BRIEF DESCRIPTION OF THE DRAWINGS

An exemplary embodiment is described hereinbelow and is illustrated in the drawing, in which.

Figure 1:
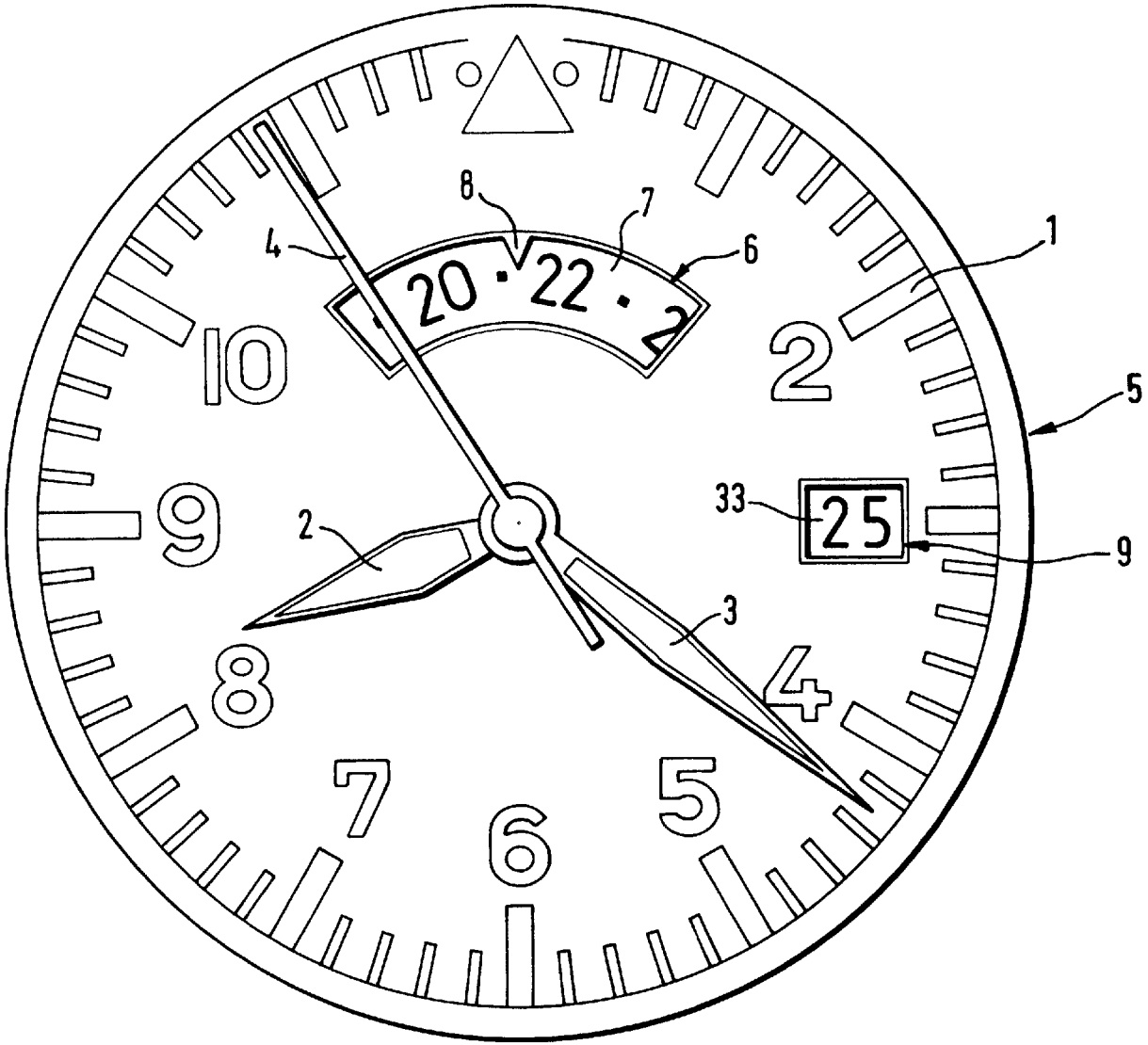
FIG. 1 shows a view of a timepiece.

The timepiece illustrated in FIG. 1 has, on a face 5, an annular 12-hour scale 1 of a 12-hour display, over which a 12-hour hand 2, a minute hand 3 and a second hand 4 pass.

In the region of the twelve o'clock position, the face 5 has hollowed out of it a window 6 which is in the form of a ring section and through which it is possible to see a 24-hour disk 7 of a 24-hour display, which disk is arranged behind the face 5 and can be driven in a rotatable manner. The time can be read off the 24-hour disk 7 by means of a marking 8 of the face 5.

In the region of the three o'clock position, the face 5 has hollowed out of it a second window 9 through which it is possible to see a date ring 33, which ring is arranged behind the face 5 and can be driven in a rotatable manner.

Figure 2:
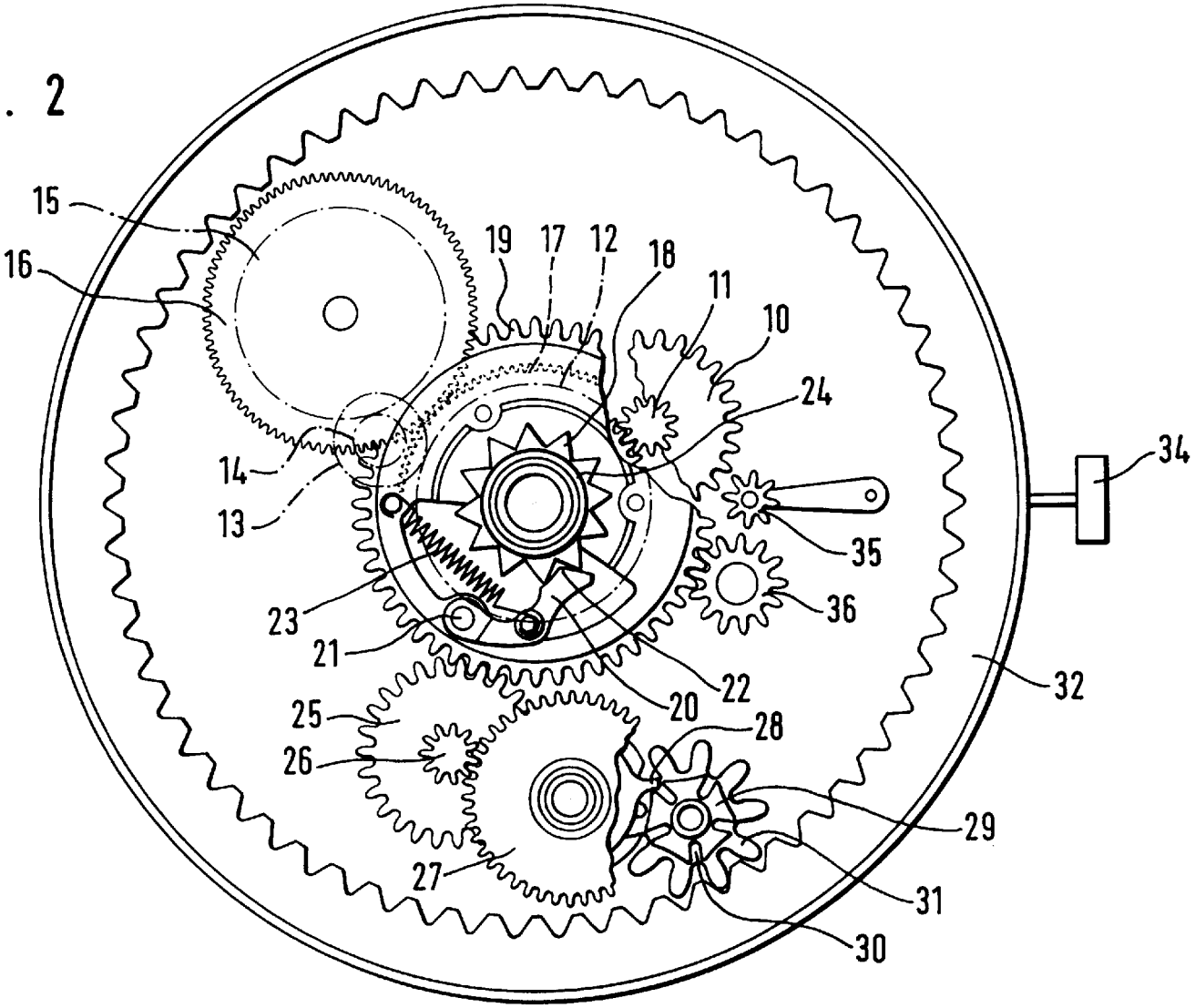
FIG. 2 shows a view of the display setting arrangement of the timepiece according to FIG. 1.
Figure 3:
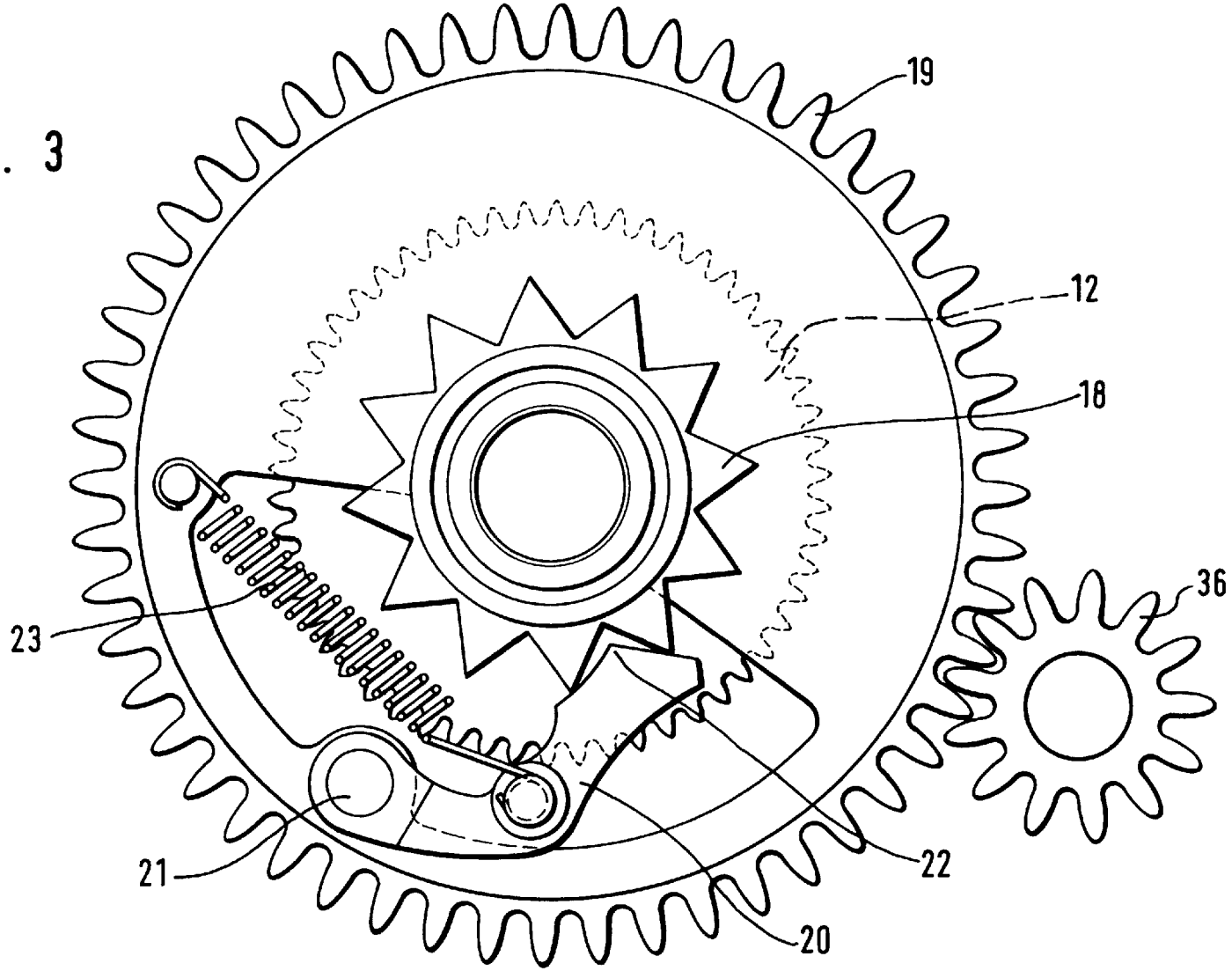
FIG. 3 shows a view of the display setting arrangement according to FIG. 2 in the region of an hour star and of an hour ratchet.

FIG. 2 illustrates a view of the display setting arrangement of the timepiece. The drive of the timepiece starts from a minute wheel (not illustrated) of a basic mechanism, by means of which a change wheel 10 can be driven in a rotatable manner. The change wheel 10 is concentrically connected in a fixed manner to a pinion 11 which drives in a rotatable manner an hour wheel 12, arranged concentrically with respect to the axis of rotation of the 12-hour hand 2, with one revolution every twelve hours.

Figure 6:
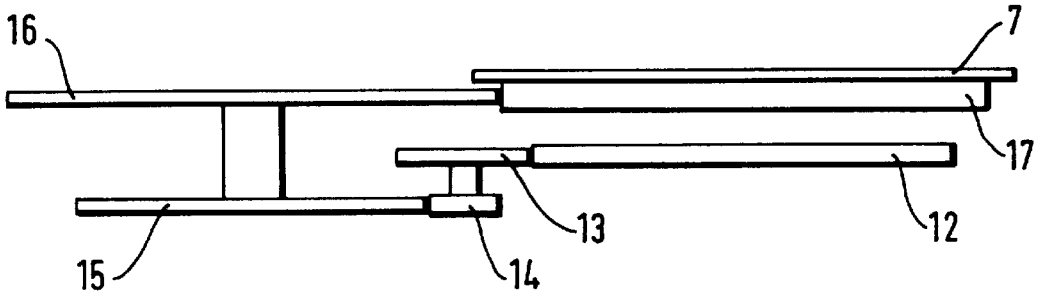
FIG. 6 shows a schematic side view of the direct gear train of the display setting arrangement according to FIG. 2.
Figure 7:
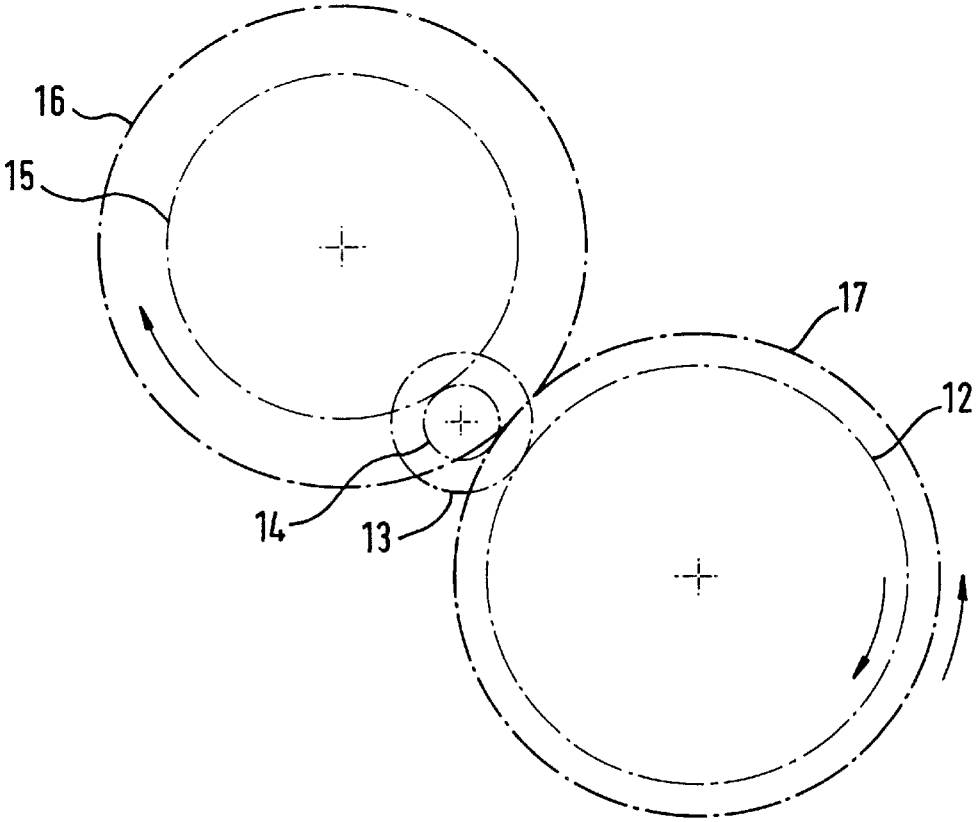
FIG. 7 shows a schematic plan view of the direct gear train according to FIG. 6.
Figure 8:
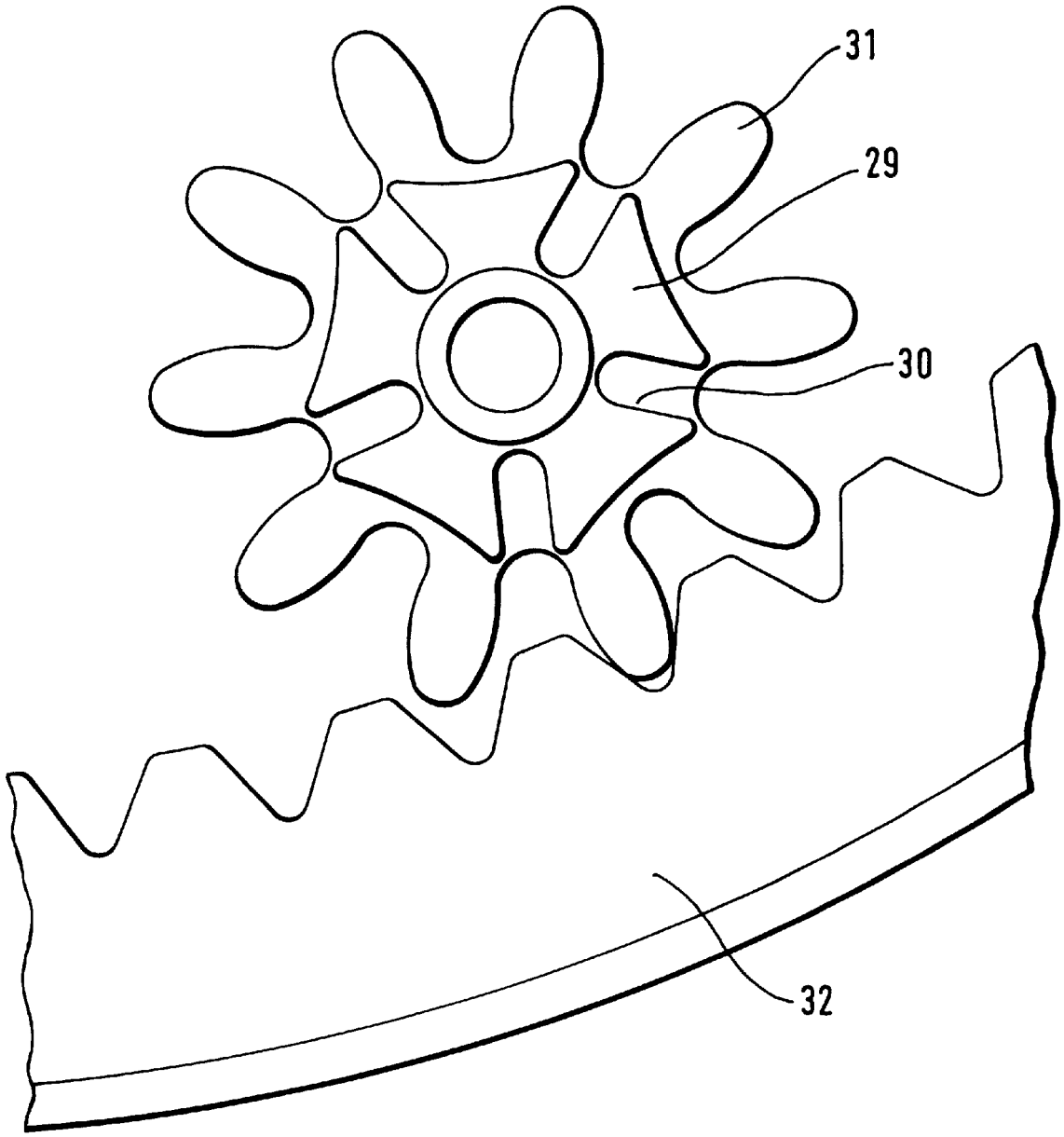
FIG. 8 shows a view of part of a date wheel with Maltese cross of the display setting arrangement according to FIG. 2.

As can be seen both in FIG. 2 and in FIGS. 6 and 7, a first 24-hour intermediate wheel, which is connected in a rotationally fixed manner to a second 24-hour intermediate wheel 16, is driven in a rotatable manner by the hour wheel 12, via a first intermediate wheel 13 and a pinion 14 which is rotationally fixed thereto.

Said second 24-hour intermediate wheel 16, in turn, drives a 24-hour display wheel 17 with one revolution every twenty-four hours, the 24-hour disk 7 being fixed on said 24-hour display wheel 17.

The drive of the 24-hour display wheel 17, starting from the minute wheel (not illustrated) of the basic mechanism, forms a non-interruptible, direct gear train.

Figure 5A:
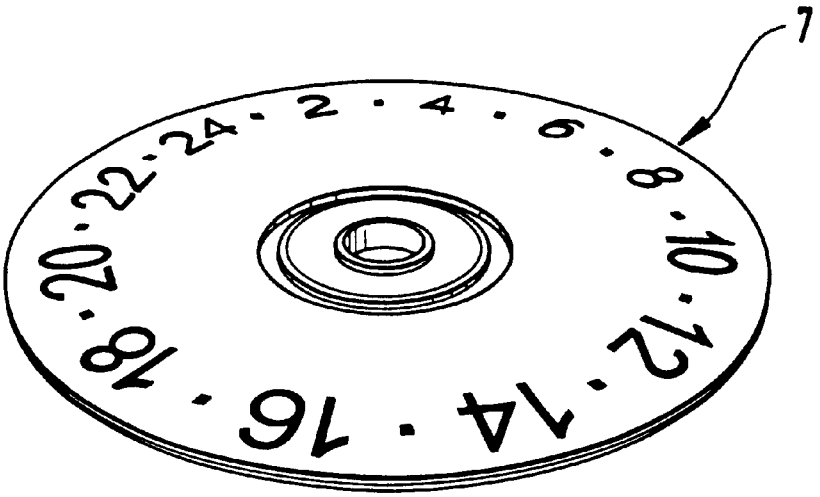
FIGS. 5*a* and 5*b* show a perspective exploded illustration of the 24-hour disk and date ring of the display setting arrangement according to FIG. 2.

As FIG. 5*a* shows, the 24-hour disk 7 has the numbers 1 to 24 distributed over it uniformly in a circle, and these numbers can then be seen through the window 6 of the face 5 as a 24-hour display.

Fixedly connected to it, the hour wheel 12 concentrically bears an hour star 18 with twelve teeth.

The hour star 18 is concentrically enclosed by an inherently freely rotatably mounted hour display wheel 19, on which an hour ratchet 20 can be pivoted about a pivot spindle 21, parallel to the axis of rotation of the hour star 18.

At the end remote from the pivot spindle 21, the hour ratchet 20 has an obtuse-angled engaging tooth 22 which, by the prestressing of a tension spring 23 acting on the hour ratchet 20, is drawn into a tooth gap of the hour star 18 and thus produces a force-fit connection between the hour star 18 and the hour display wheel 19.

The hour display wheel 19 is also thereby driven by the basic mechanism, via the hour wheel 12, with one revolution every twelve hours.

Since the 12-hour hand 2 is arranged on the hour stem 24 of the hour display wheel 19, said 12-hour hand 2 moves with one revolution every twelve hours and, along with the 12-hour scale 1, forms a 12-hour display, which can be driven by the 12-hour gear train, which leads from the hour wheel 12 to the hour stem 24.

A third gear train starts from the hour display wheel 19, this third gear train having a date reduction wheel 25 which engages in the hour display wheel 19 and of which the drive 26, fixed thereon, drives a date switching wheel 27 with one revolution every twenty-four hours.

Figure 9:
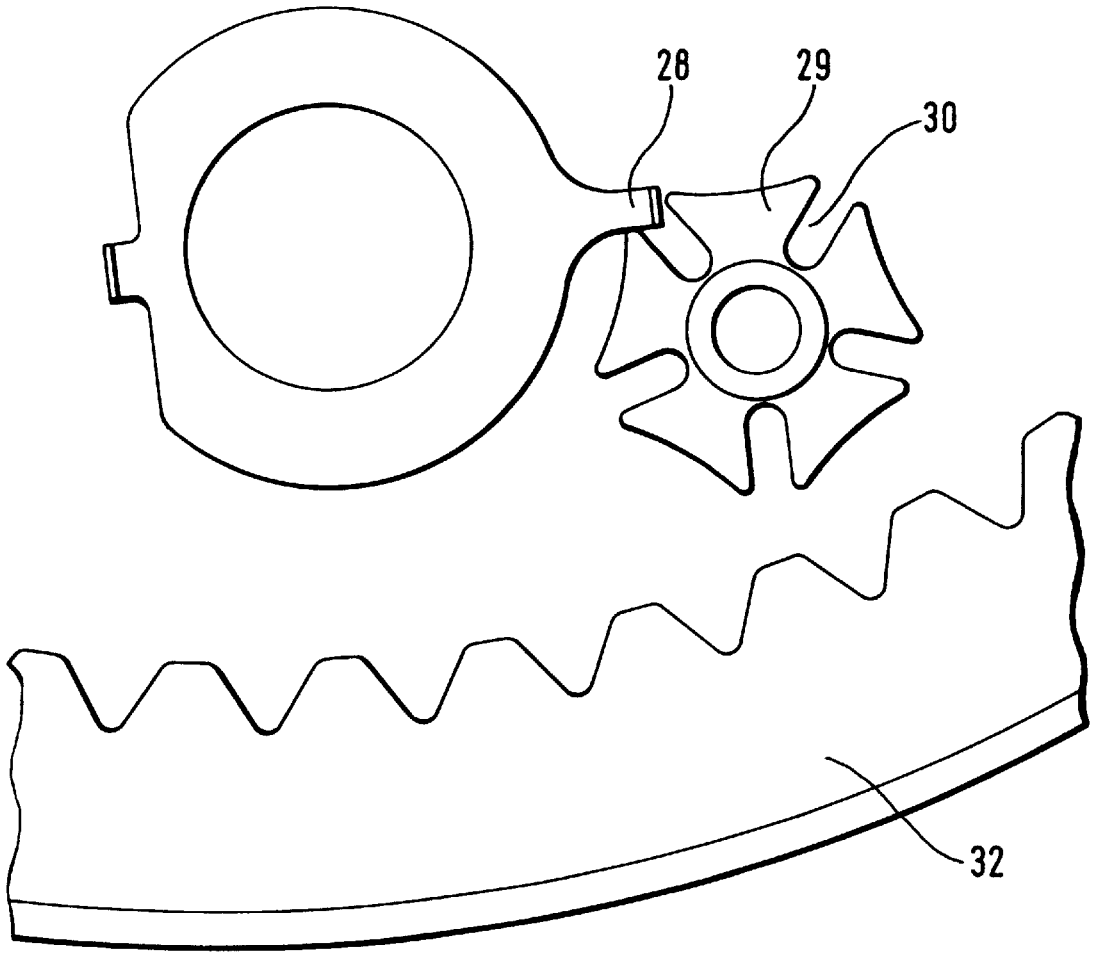
FIG. 9 shows a view of part of a wheel with switching finger and of the Maltese cross of the display setting arrangement according to FIG. 2.

Fixedly connected to the date switching wheel 27 is a radially directed switching finger 28 by means of which, as FIG. 9 shows in more detail, a Maltese cross 29 with five advancement grooves 30 can be advanced.

Fixedly connected to the Maltese cross 29 is a date wheel 31 which has ten teeth and engages in the teeth of a toothed ring 32 which is concentrically arranged in a rotatable manner with respect to the hour stem 24, is designed as an internal toothed ring, has sixty-two teeth and bears a date ring 33.

Figure 5B:
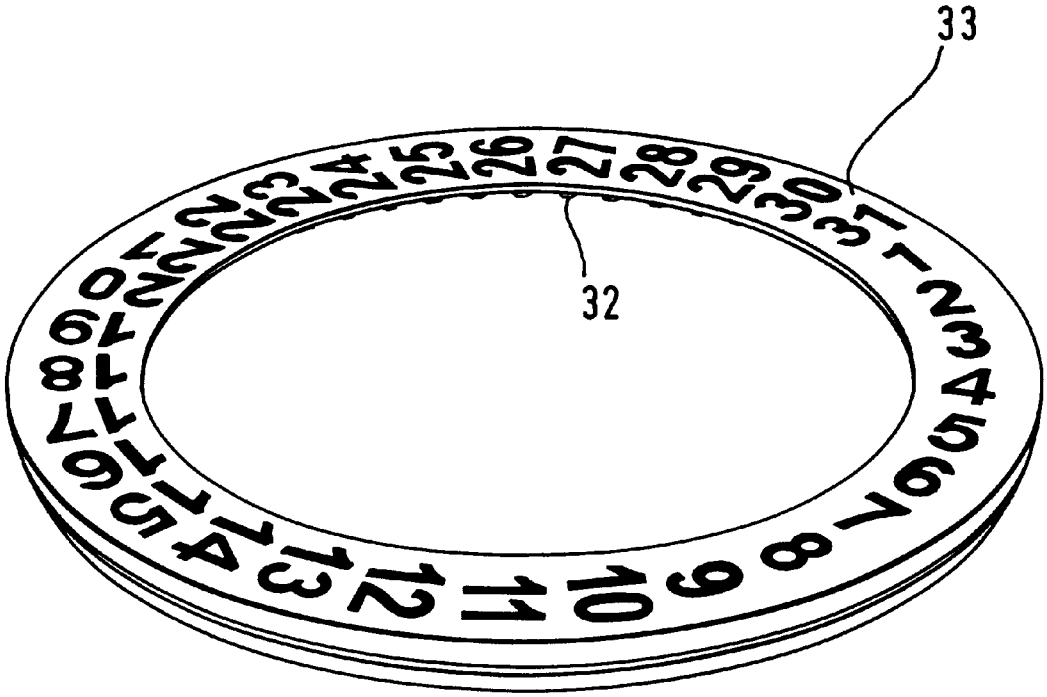

Distributed uniformly on the date ring 33, as FIG. 5*b* shows, are the numbers 1 to 31, which can be seen through the window 9 in the face 5. The advancement of the Maltese cross 29 by one advancement step every twenty-four hours also allows, every twenty-four hours, further rotation of the date wheel 31 and of the toothed ring 32 by two teeth, with the result that the date number, which can be seen in the window 9, is advanced every twenty-four hours.

Figure 4A:
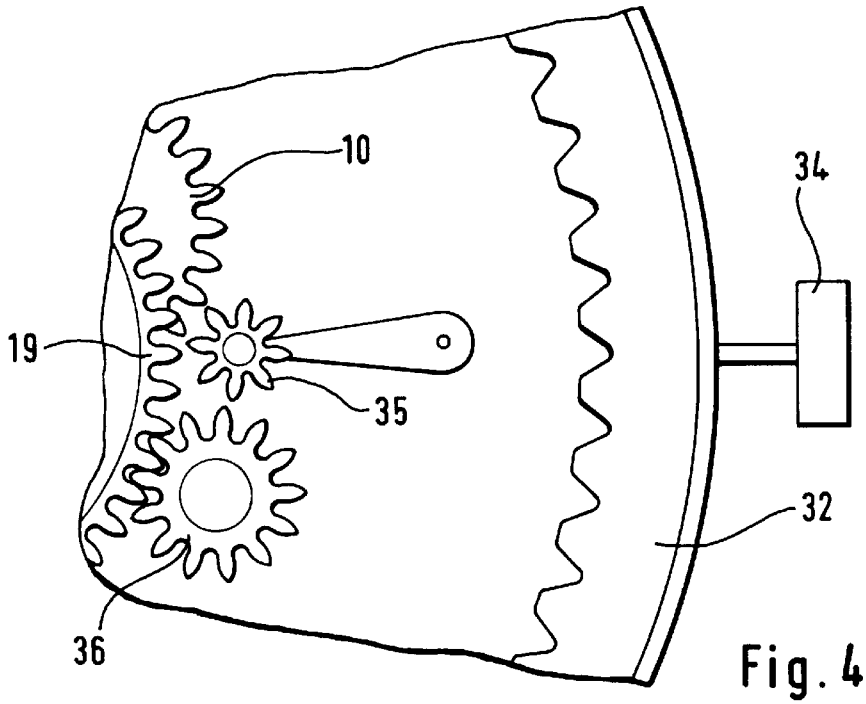
FIG. 4*a* shows a view of the display setting arrangement according to FIG. 2 in the region of a hand setting wheel, in the neutral position.
Figure 4B:
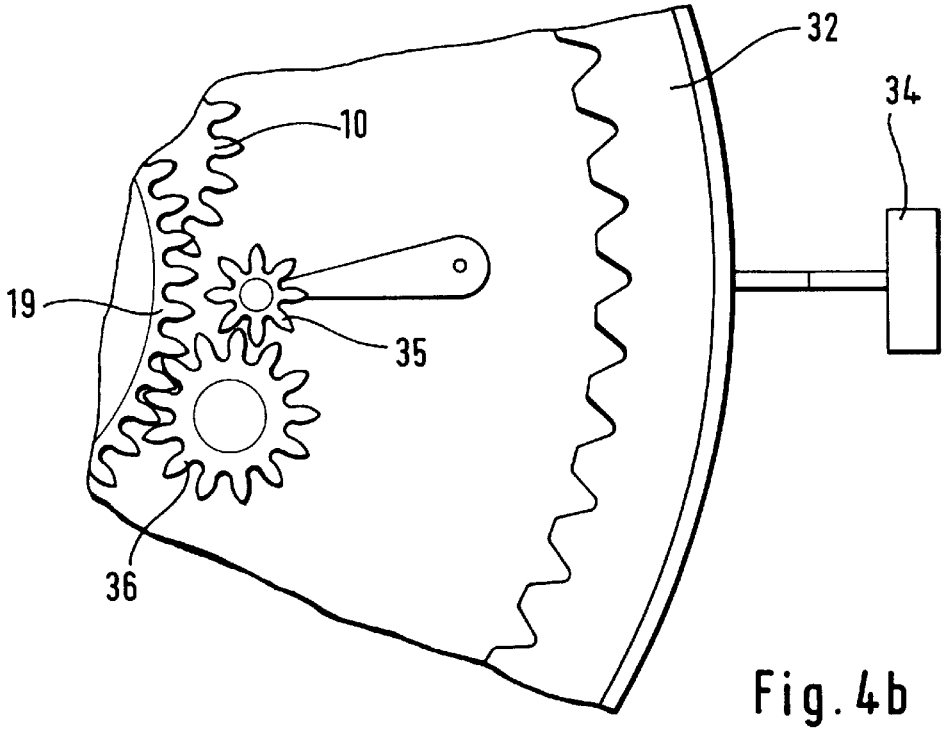
FIG. 4*b* shows the display setting arrangement according to FIG. 4*a* in the correction position of the 12-hour display.
Figure 4C:
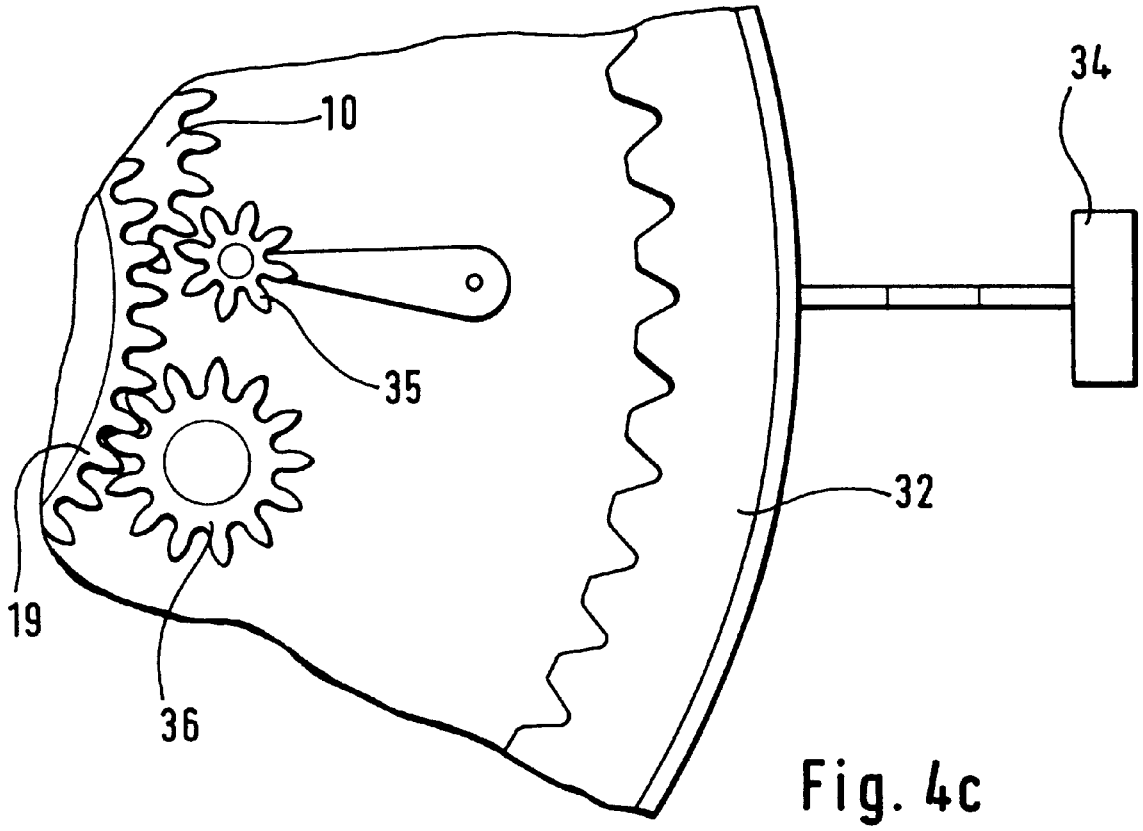
FIG. 4*c* shows the display setting arrangement according to FIG. 4*a* in the correction position of the entire display arrangement.

FIGS. 4*a*, 4*b* and 4*c* illustrate a winder 34 which can be set in three axial setting positions and by means of which a hand setting wheel 35 can be driven in a rotatable manner.

In the setting position illustrated in FIG. 4*a*, which is a winding setting position, the hand setting wheel 35 engages in a drive mechanism of the spring mechanism of the timepiece (said drive mechanism not being illustrated), with the result that the spring mechanism of the timepiece can be wound up by means of the winder 34.

In the central setting position, illustrated in FIG. 4*b*, the hand setting wheel 35 engages in a correction drive mechanism 36 which, in turn, is in engagement with the hour display wheel 19. The hour display wheel 19 can thus be driven in a rotatable manner by virtue of the winder 34 being rotated.

Since said hour display wheel 19 is connected to the hour star 18, with a force fit, via the hour ratchet, but said hour star 18 is connected to the basic mechanism via pinion 14, hour wheel 12 and change wheel 10 and is prevented from rotating by said basic mechanism, the hour display wheel 19 rotates relative to the hour star 18, overcoming the force fit of the engaging tooth 22 in the hour star 18 in the process. In this case, the engaging tooth 22 slides out of one tooth gap of the hour star 18 in a ramp-like manner and latches, under the prestressing of the tension spring 23, into the adjacent tooth gap. This adjusts the 12-hour hand 2 of the 12-hour display by one hour precisely.

However, this adjustment also takes place at the third gear train, which leads to the toothed ring 32, with the result that the date display is adjusted in correspondence with the adjustment of the 12-hour display. In this case, adjustments may take place both in the forward and in the rearward direction.

FIG. 4*c* illustrates the winder 34 in its fully drawn-out position. In this case, the hand setting wheel 35 engages in the change wheel 10. Rotation of the winder 34 then results both in the minute wheel of the basic mechanism being rotated, and thus the minute hand 3 being adjusted, via the change wheel 10 and in the hour wheel 12 being rotated via the pinion 11.

The hour wheel simultaneously achieves adjustment of the 24-hour disk of the 24-hour display, via the direct gear train, adjustment of the 12-hour hand 2 of the 12-hour display, via the 12-hour gear train, and adjustment of the date ring of the date display, via the third gear train.

What is claimed is:

1. A display setting arrangement for a timepiece, in particular a wristwatch, having a 12-hour display, on which, driven in a rotatable manner by a basic mechanism with two revolutions every 24 hours, hours can be displayed, having a second hour display which can be driven in a rotatable manner likewise by the basic mechanism, and having a correction device, by which the 12-hour display can be adjusted manually relative to the second hour display, wherein the second hour display is a 24-hour display and can be driven in a rotatable manner, in a direct gear train, by the basic mechanism of the timepiece with one revolution every 24-hours, and wherein, via a force-fit connection, a 12-hour gear train is drivable in a rotatable manner, for purpose of driving the 12-hour display, by a direct-gear-train wheel which is driven with one revolution every 12-hours, wherein by means of a setting device which is manually actuatable, it is possible to adjust, separately from one another, either the direct gear train or, by overcoming the force fit of the force-fit connection, the 12-hour gear train relative to the direct gear train.

2. The display setting arrangement as claimed in claim 1, wherein the setting device, which is manually actuatable, has a correction drive mechanism (36) which is drivable in a manually rotatable manner and by means of which it is possible to adjust an hour display wheel (19) of the 12-hour gear train, said wheel being driven in rotation with two revolutions every 24 hours.

3. The display setting arrangement as claimed in claim 2, wherein said hour display wheel (19) concentrically encloses a direct-gear-train star, which is driven with one revolution every 12 hours, and is connected thereto with a force fit.

4. The display setting arrangement as claimed in claim 3, wherein arranged on the hour display wheel (19) is an hour ratchet (20) which is pivotable about a pivot spindle (21), parallel to the axis of rotation of the hour display wheel (19) and star, and, at a distance from the pivot spindle (21), has an obtuse-angled engaging tooth (22) which engages, with spring prestressing, in a tooth gap of the star.

5. The display setting arrangement as claimed in claim 4, wherein the star is an hour star (18) with twelve teeth.

6. The display setting arrangement as claimed in claim 1, wherein a minute wheel of the basic mechanism can drive in a rotatable manner a change wheel (10) which is concentrically connected in a rotationally fixed manner to a pinion (11), by which a star-driving hour wheel (12) of a direct drive train is drivable in a rotatable manner with one revolution every 12 hours.

7. The display setting arrangement as claimed in claim 6, wherein the change wheel (10) is drivable in a rotatable manner by a hand setting wheel (35) which is drivable in a manually rotatable manner and belongs to the setting device, which is manually actuatable.

8. The display setting arrangement as claimed in claim 7, wherein the hand setting wheel (35) is adustable between a position in which it engages in the change wheel (10) and a position in which it engages in a correction drive mechanism (36).

9. The display setting arrangement as claimed in claim 8, wherein the hand setting wheel (35) is settable in a neutral position, between the position in which it engages in the change wheel (10) and the position in which it engages in the correction drive mechanism (36).

10. The display setting arrangement as claimed in claim 7, further comprising a winder, and wherein the hand setting wheel (35) is drivable in a rotatable manner by said winder (34).

11. The display setting arrangement as claimed in claim 10, wherein the winder (34) is settable axially in two setting positions, wherein in a first setting position the hand setting wheel (35) engages in the correction drive mechanism (36) and in a second setting position it engages in the change wheel (10).

12. The display setting arrangement as claimed in claim 11, wherein the winder (34) is settable in a third axial setting position, in which the hand setting wheel (35) is disengaged both from the correction drive mechanism (36) and from the change wheel (10).

13. The display setting arrangement as claimed in claim 12, wherein the third axial setting position of said winder (34) is a winding position for winding a spring mechanism of the timepiece.

14. The display setting arrangement as claimed in claim 1, wherein a direct drive train has a 24-hour display wheel (17) which is driven by the hour wheel (12), via at least one intermediate wheels (13–16), with one revolution every 24 hours and bears a 24-hour disk (7) of the 24-hour display.

15. The display setting arrangement as claimed in claim 14, wherein said 24-hour disk (7) is arranged coaxially with respect to the 12-hour display.

16. The display setting arrangement as claimed in claim 15, wherein said 24-hour disk (7) and the 24-hour display wheel (17) have a concentric opening through which there projects an hour stem (24) of the 12-hour display, said stem bearing an hour hand (2).

17. The display setting arrangement as claimed in claim 1, wherein a date display is drivable by an hour display wheel (19), via a third gear train.

18. The display setting arrangement as claimed in claim 17, wherein the date display has a date ring (33) which is arranged on a toothed ring (32) and bears the characters of the date display, wherein the toothed ring (32) is advancable by one advancement step by means of the third gear train, and following thirty-one advancement steps has been rotated through 360°.

19. The display setting arrangement as claimed in claim 18, wherein said third gear train has a Maltese-cross drive mechanism which produces the advancement steps.

20. The display setting arrangement as claimed in claim 19, wherein the toothed ring (32) is drivable such that it can be advanced by a data wheel (31) which is coaxially connected in a rotationally fixed manner to a Maltese cross (29), wherein the Maltese cross (29) is advancable by a switching finger (28) of a date switching wheel (27) which is drivable in a rotatable manner.

21. The display setting arrangement as claimed in claim 20, wherein the date switching wheel (27) is drivable in a rotatable manner, with one revolution every 24 hours, by the drive mechanism (26) of a date reduction wheel (25) which is in engagement with the hour display wheel (19).

22. The display setting arrangement as claimed in claim 20, wherein the Maltese cross (29) is advancable by a fifth of a revolution per advancement step.

23. The display setting arrangement as claimed in claim 18, wherein the toothed ring (32) is an internal toothed ring.

24. The display setting arrangement as claimed in claim 18, wherein the toothed ring (32) is coaxial with respect to the 12-hour display and/or the 24-hour display.

* * * * *